United States Patent [19]

Shibuya et al.

[11] Patent Number: 4,988,208

[45] Date of Patent: Jan. 29, 1991

[54] METHOD OF AND APPARATUS FOR MIXING OR DISPERSING PARTICLES

[75] Inventors: Akira Shibuya, Tokyo; Michio Aoyama, Kitakyushui; Isao Kimura, Tokyo, all of Japan

[73] Assignee: Koshin Kenki Kogyo Co., Ltd., Tokyo, Japan

[21] Appl. No.: 252,248

[22] Filed: Sep. 30, 1988

[30] Foreign Application Priority Data

Oct. 8, 1987 [JP] Japan ..... 62-252333
Mar. 30, 1988 [JP] Japan ..... 63-74565

[51] Int. Cl.[5] ..... B01F 11/00
[52] U.S. Cl. ..... 366/108
[58] Field of Search ..... 366/273, 108, 274, 348, 366/349, 127

[56] References Cited

U.S. PATENT DOCUMENTS

| | | | |
|---|---|---|---|
| 2,549,644 | 4/1951 | Silverman | 366/349 |
| 3,219,318 | 11/1965 | Hershler | 422/257 |
| 3,314,670 | 4/1967 | Kennedy | 366/108 |
| 3,439,899 | 4/1969 | Hershler | 366/348 |
| 3,815,115 | 6/1974 | Inque | 366/273 |
| 3,987,967 | 10/1976 | Kuznetsov | 366/273 |
| 3,995,835 | 12/1976 | Cichy et al. | 366/273 |
| 4,720,025 | 1/1988 | Tatevosian | 366/273 |

FOREIGN PATENT DOCUMENTS

| | | | |
|---|---|---|---|
| 118005 | 7/1982 | Japan | 366/273 |

*Primary Examiner*—Harvey C. Hornsby
*Assistant Examiner*—Joseph S. Machuga
*Attorney, Agent, or Firm*—Gossett Dykema

[57] ABSTRACT

A method of and an apparatus for mixing or dispersing particles using a gradient force produced by a contact type electric field curtain. The particles are mixed or dispersed by permitting them to be put in a dielectric container and passing them through the area of influence of the electric field curtain.

11 Claims, 4 Drawing Sheets

METHOD OF AND APPARATUS FOR MIXING OR DISPERSING PARTICLES

BACKGROUND OF THE INVENTION

1. Technical Field

This invention relates to a method and an apparatus for mixing or dispersing particles based upon the principle of a contact type electric field curtain.

2. Background Art

A prior contact type electric field curtain is comprised of a train of electrodes and of a dielectric layer placed in close vicinity of or in contact with the electrodes, as disclosed in Japanese Patent Publication Kokoku No. 54-12667 "A Method Of Constructing A Contact Type Electric Field Curtain And An Apparatus With Use Therewith". The electric field curtain is adapted in operation to permit a lightweight substance on the dielectric layer to have thereon electric charges induced by contact thereof with the electric layer and to be rendered to electrodynamical force afforded by the electric field curtain. So that the lightweight substance is thereby repelled and driven.

Referring to FIG. 9, the arrangement described above is illustrated.

Electrodes a, which are rod-shaped or donut-shaped, for forming an electric field curtain are aligned, and spaced from each other. Alternating voltage b is applied between the adjacent electrodes for an alternating non-uniform electric field having electric force lines indicated by dotted line c around the respective electrodes a. The alternating non-uniform electric field changes its magnitude and direction with respect to space, while with respect to time it changes its direction sinusoidally.

As charged particles approach the alternating non-uniform electric field, the particles are the influence of alternating electric force along the line of electric force, c and hence are forced to oscillate substantially along the curved line of electric force c, whereby the charged particles are rendered to puroduce a, outward centrifugal force which is perpendicular to the lines c each half period of the oscillation. Those particles are thus subjected to mean centrifugal force Fc.

Each particles is is subjected, at a location close to the electrode a where the electric field is stronger, to the electric force oriented to go away from the electrode a, while being subjected, at a location far from the electrode a where the electric field is weaker, to the electric force oriented toward the elctrode a. This is because the particles oscillate in a viscous medium. Either way, as a result of the difference therebetween, the particle is rendered to the mean gradient force Fg directed along the line of electric force, c going away from the electrode a.

The mean centrifugal force Fc is produced owing to a spatial change (curved configuration) of the direction of the electric force line c, while the gradient force Fg is produced due to a spatial change of the density of the lines c (a gradient of electric field intensity). Both are produced because of the electric field being non-uniform and alternate. Thus, the particle is subjected to composite force formed therein, i.e., electrodynamic repulsion force Fr in the direction going away from the electrode train.

The particles adhering to the dielectric layer when the latter is taken into the electric field are charged immediately with electricity on the basis of the principle of the contact charge and forced to float from the dielectric layer owing to the aformentioned electrodynamical repulsion force.

Such a contact type electric field curtain apparatus finds application in electrostatic precipitators, electrostatic coating booths, and electrostatic guns, where particles have to be swept off or moved by a repulsion force.

The present inventioh has been devised based on recognition of the fact that any particle present in the action area of the electric field curtain is subjected to violent disturbance.

SUMMARY OF THE INVENTION

It is an object of the present invention to provide a method and an apparatus capable of mixing or dispersing particles electrodynamically.

Another object of the present invention is to provide a method and an apparatus capable of mixing or dispersing particles contained in a container.

Still another object of the present invention is to provide a method and an apparatus capable of mixing or dispersing particles contained in a layer by inserting or arranging an apparatus embodying the present method in the layer.

According to one aspect of the present invention, there is provided a method of mixing or dispering particles contained in a dielectric vessel by arranging the vessel in the action area of an electric field curtain.

According to another aspect of the present invention, there is provided an apparatus including electrodes for forming an electric field curtain arranged to surround a dielectric container in which particles to be mixed or dispersed are contained, and a power supply for establishing an alternating electric field in the form of a standing wave or a traveling wave in the vicinity of the electrodes for forming the electric field curtain.

DESCRIPTION OF THE PREFERRED EMBODIMENTS

Figure 1:
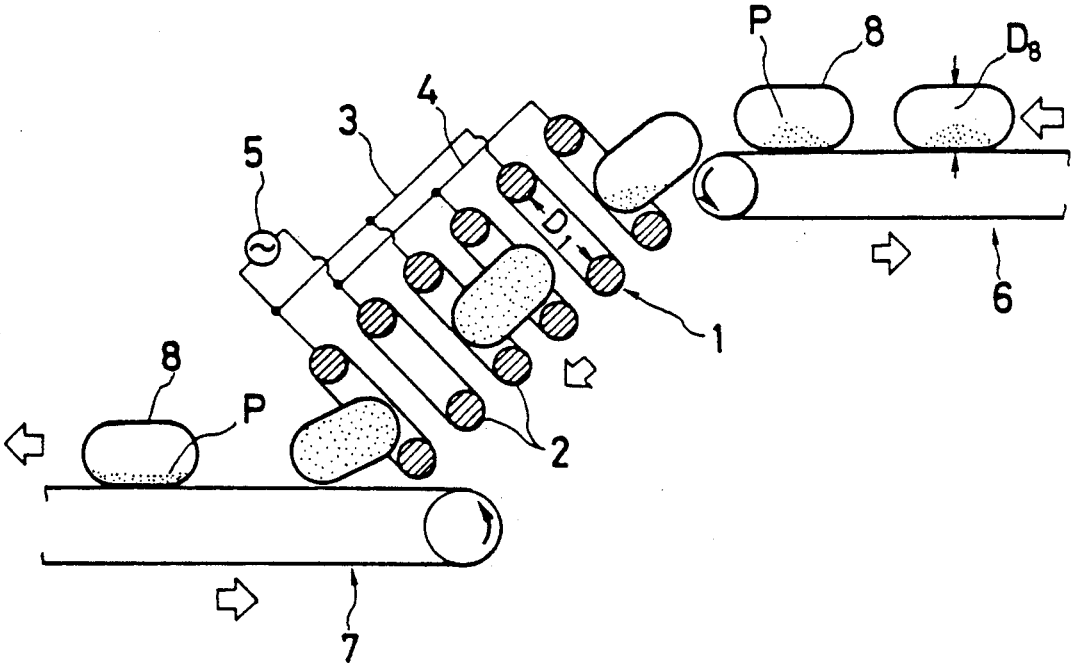
FIG. 1 is a front view in cross section illustrating an embodiment of the present invention.

Referring to FIG. 1, an embodiment of an apparatus for mixing or dispersing particles according to the present invention is illustrated.

An electrode assembly 1 for forming an electric field curtain is constructed like a cylinder by aligning with equal intervals a plurality of donut-shaped electrodes 2, each being insulated from another. It is to be noted that it is also satisfactory to attach the electrodes to an inner wall of a cylinder made of insulating material or to bury them in such a wall (not shown). The respective electrode 2 of the electrode assembly 1 are alternately interconnected to conductors 3, 4, and connected to a single-phase or three-phase alternating power supply 5 of 4 to 15 kV and of a frequency ranging from 30 to 90 IIz. The electrode assembly 1 is arranged on an incline, on the upper of which a carrying-in conveyor 6 being provided and on the lower of which a carrying-out conveyor 7 provided.

Meanwhile, particles p to be mixed or dispersed are put in a dielectric vessel 8 made of glass or plastic. The particles p may be a group of various kinds of powders to be mixed or cohered powders to be dispersed or materials in a colloidal state, emulsion state or slurry state which have to be mixed or dispersed. The present invention finds its application, for example, in mixing of the main ingredient of medicine with additives, mixing of various chemical agent powders as well as of superconductor raw material powders as new application of fine ceramics, mixing of colorants of plastics for injection molding and mixing of reinforcement additives for such plastics, and mixing of wheat flour with a vitamin additive in a baking process, etc.

The present invention further finds other applications: uniform dispersion of cohered powder particles; and dispersion of particles in slurry, colloid, or emulsion in the vessel 8.

For the vessel 8, arbitrarily-shaped ones such as capsules, ampuls, reagent bottles, and test tubes may be employed. The vessel 8 has its outer diameter D8 smaller than the inner diameter Dl of the electrode assembly 1 such that it can pass through the inside of the electrode assembly 1. Now, operation of the illustrated embodiment will be described.

Figure 9:
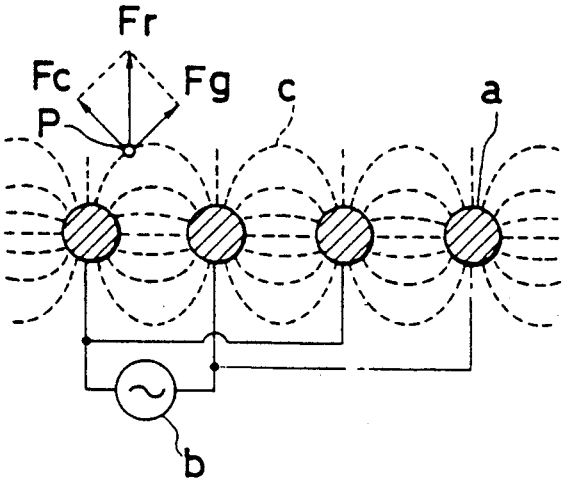
FIG. 9 is a view illustrating the principle of an electric field curtain.

Referring to FIG. 1, with the application of single-phase high tension from the alternating single-phase power supply 5 to the respective electrodes 2 of the electrode assembly 1, an electric field curtain is established inside the electrode assembly 1, as illustrated in FIG. 9. Then, the container 8 containing therein the particles p to be mixed or dispersed is dropped into the electrode assembly 1 from the carrying-in conveyor 6. Hereby, the particles p in the vessel 8 are charged with electricity based upon the contact charge with the vessel 8 during the passage through the action area of the electric field curtain, and thereby disturbed. The particles p are thus mixed or disturbed completely before reaching the carrying-out conveyor 7. Such mixing or dispersing process is continuously performed by permitting many vessels 8 to pass in succession through the electrode assembly 1 by the carrying-in conveyor 6, as illustrated in the FIG. 1.

Figure 4:
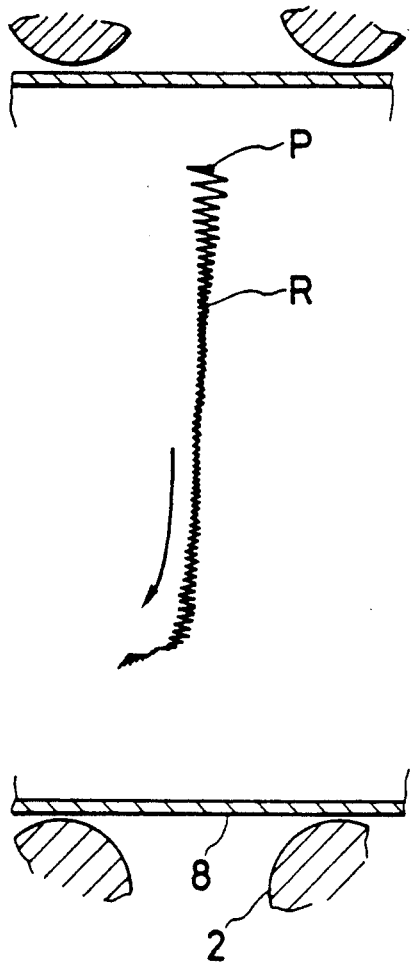
FIGS. 4 and 5 are views each illustrating the behavior of particles according to the present invention.

Referring to FIG. 4, behavior of the particles in the area of influence of the electric field curtain is illustrated. The adjacent electrodes 2 are supplied with alternating single-phase voltage of 14 kV. The particle p oscillates in the direction of the electric force line as shown by a trajectory R while moving downward in the direction indicated by the arrow in FIG. 4. Each particle p contained in the vessel 8 is disturbed in such a manner by being subjected to the electrodynamic force produced by the electric field curtain. Accordingly, any power, which is contained in the vessel 8, can be uniformly mixed, or uniformly dispersed when aggregated.

Figure 5:
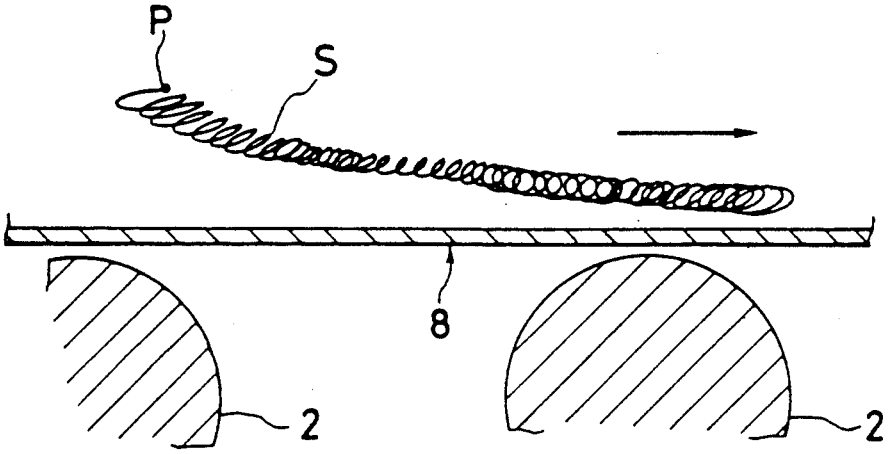

Here, when an alternating three-phase power supply is employed as the power supply 5, the electric field curtain travels as a traveling wave. That is, the particle p osillates as indicated by S in FIG. 5, and travels in the direction the traveling wave moves as shown by the arrow. In the case of the electrode assembly 1 of FIG. 1, the power supply 5 may be connected in a manner such that the traveling wave may be directed in a direction the container 8 falls or in another direction opposite thereto.

Figure 2:
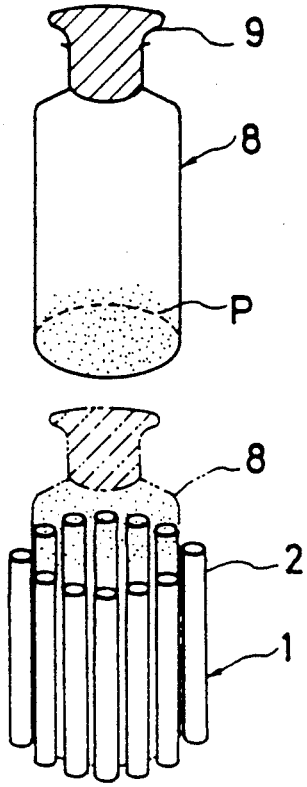
FIGS. 2 and 3 are perspective views each illustrating other embodiments of the present invention.
Figure 3:
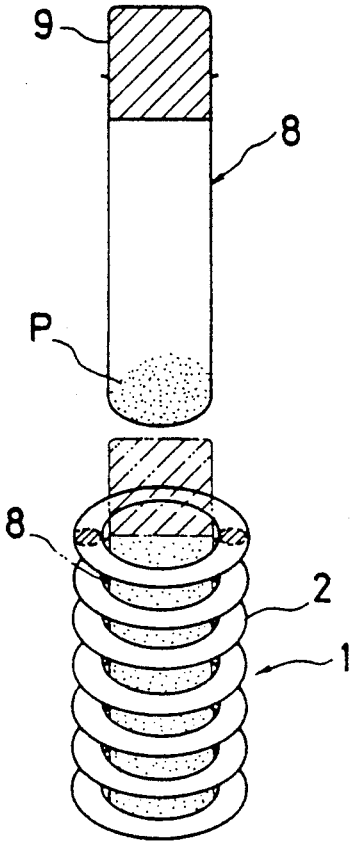

Referring now to FIGS. 2 and 3, other embodiments of the present invention are illustrated.

As illustrated in FIG. 2, an electrode assembly 1 consists of rod-shaped electrodes 2 arranged circularly in the form of a cage. The electrodes 2 are connected to an alternating single-phase or three-phase power supply (not shown). A reagent bottle is employed as a container 8 into which powder particles p to be mixed or dispersed are put after removal of a plug 9 and which is thereafter closed with the plug 9. The vessel 8 is placed inside the electrode assembly 1 as shown by the double dotted chain line for mixing and dispersion of the particles p.

As illustrated in FIG. 3, an electrode assembly 1 is hollow and cylindrically shaped, and a test tube is employed as a container 8. The test tube 8 accomodating particles p is closed with the plug 9 and inserted in the electrode assembly 1 so that the particles p may be mixed or dispersed.

Figure 6:
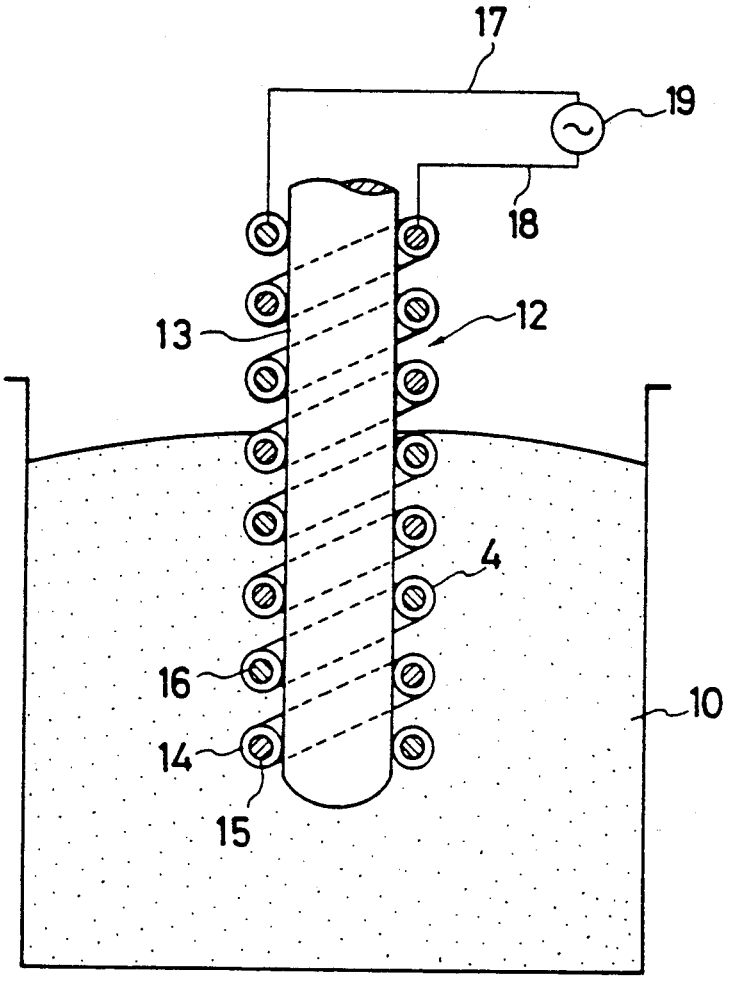
FIG. 6 is a front view in cross section illustrating further another embodiment of the present invention.
Figure 7:
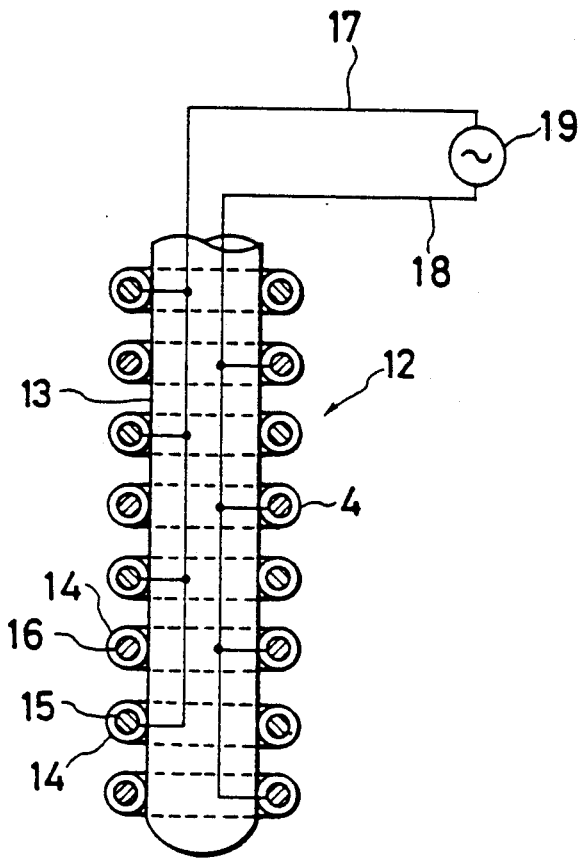
FIGS. 7 and 8 are views each illustrating an example of electrodes for forming an electric field curtain shown in FIG. 6.
Figure 8:
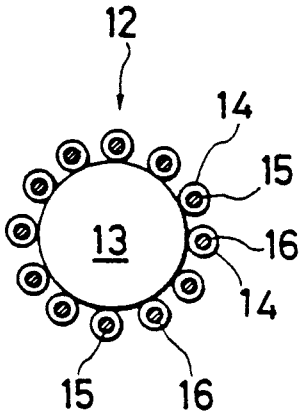

Referring further to FIGS. 6 to 8, yet other embodiments of the present invention are illustrated.

In FIG. 6, reference numeral 10 designates a particle layer to be mixed or dispersed. The particle layer 10 may be varieties of powders or powders in an aggregation state or other materials such as colloid, emulsion or slurry. The present embodiment finds its application for example in mixing of the main pharmaceutical ingredient with additives, mixing of various chemical agent powders, mixing of superconductor raw material powders as new application of fine ceramics, mixing of colorants of plastics for injection molding, mixing of reinforcement additives for said plasitics, and mixing of wheat flour with vitamin additives in a baking process.

As for dispersion, the present embodiment finds its application in uniformly dispersing of powder particles aggregated in the particle layer 10 and in dispersing of liquid or solid paticles in slurry, colloid, or emulsion.

An electrode assembly 12, which is coated with a dielectric, is comprised of an electode supporter 13 made of an insulator such as a glass rod, and a pair of electrodes 15, 16 each electrode being coated with dielectrics 14 and helically wound around the outer periphery of the electrode supporter 13. Both electrodes 15, 16 are connected to a power supply 19 of for example an alternating single-phase via conductors 17, 18.

The electrode assembly 12 may be adapted to include as shown in FIG. 7 circular ring-shaped electrodes 15, 16 instead of the helical ones 15, 16 shown in FIG. 6, which electrodes are connected to the power supply 19 via conductors 17, 18 provided in an electrode supporter 13, or adapted to include rod-shaped electrodes 15, 16 provided on the outer periphery of the electrode supporter 13 axially thereof as shown in FIG. 8.

Additionally, the dielectric-coated electrode assembly 12 may be constructed by forming the electrode supporter 13 with fine ceramics instead of mountiong the electrodes 15, 16 coated with the dielectric 14 on the electrode supporter 13, and burying the electrodes 15, 16 in the electrode suporter 13 as the supporter is molded and then all of them are calcined together.

For the power supply 19 an alternating three-phase power supply, which forms a traveling wave, may be employed other than the alternating single-phase power supply which forms a standing wave.

Operation of the embodiment described above is as follows.

First, application of the alternating single-phase power supply to the electrodes 15, 16 of the electrode assembly 12 causes formation of a non-uniform alternating electric field between the respective adjacent electrodes 15, 16. In this situation, insertion or pre-arrangement of the electrode assembly 12 into or in the particle layer 10 causes the particles in the particle layer 10 to be violently disturbed owing to the electrodynamical force exerted by the electric field curtain, whereby the particles in the particle layer 10 are mixed or dispersed. Here, mechanical movement of the electrode assembly 12 in the particle layer 10 assures more uniform mixing or dispersion of the particles in the particle layer 10. Arangement of the electrode assembly 12 in the vicinity of the discharge outlet of a hopper for storing and discharging varieties of particles prevents stored particles from crosslinking, thereby assuring satisfactory discharge.

Although in the above embodiments with reference to FIGS. 1 to 8 the electrod assembly 1 was cylindrical, a flat plate type assembly or curved one may be employed.

Moreover, although for the power supply 15 a single-phase or three-phase one was employed, a DC power supply superimposed on those power supplies may be employed.

Furthermore, although in the above embodiments the container 8 accomodating particles p was adapted to pass through the inside of the electrode assembly 1 or enter the interior of the electrode assembly 1, the electrode assembly 1 may be moved so as to apply the electric curtain to the container 8.

What is claimed is;

1. A method of mixing particles, comprising the steps of:

putting particles to be mixed in a dielectric container;

bringing said dielectric container into the area of influence of an electrode assembly for forming an electric field curtain sufficient to electrify the particles; and, allowing the particles in the container to contact the container in said area of influence so as to mix the electrified particles.

2. A method of mixing particles according to claim 1 further including the steps of forming said electrode assembly by cylindrically arranging a plurality of circular ring-shaped electrodes, each being insulated from the other and spaced from the other at equal intervals, and passing said container through an interior space of the electrode assembly.

3. A method of mixing particles according to claim 1 further including the steps of forming said electrode assembly by cylindrically arranging a plurality of rod-shaped electrodes, the electrodes being insulated from each other and spaced from each other at equal intervals, and inserting said container into the electrode assembly.

4. A method of mixing particles according to claim 1 further including the step of passing said particles without interruption through the area of influence of the electric field curtain produced by the electrode assembly.

5. A method of mixing particles according to claim 1, wherein various kinds of powders are put in said container, and then mixed uniformly.

6. A method of mixing particles according to claim 1, wherein powders which have been aggregated are put in said container and dispersed.

7. An apparatus for mixing particles comprising:

a dielectric container for accommodating particles to be mixed;

an electrode assembly for forming an electric field curtain, said assembly being formed to have an inner diameter larger than an outer diameter of said dielectric container and including a plurality rod shaped electrodes spaced apart from each other at equal intervals; and a power supply for applying AC high voltage to respective electrode of said electrode assembly.

8. An apparatus for mixing particles according to claim 7 wherein said electrode assembly is cylindrically formed and said electrodes are circular ring-shaped electrodes and the assembly includes means for insulating the electrodes from each other.

9. An apparatus for mixing particles according to claim 7 wherein said electrode assembly is formed cylindrially by cylindrically arranging said electrodes and including means for insulating the electrodes from each other.

10. An apparatus for mixing particles according to claim 7, wherein said power supply is an alternating supply having a voltage of 4 to 15 kV and a frequency of 30 to 120 Hz.

11. An apparatus for mixing particles comprising:

a cylindrical electrode assembly for forming an inclined electric field curtain defined by a plurality of circular ring-shaped electrodes spaced from each other at equal intervals with the longitudinal axis of the cylindrical electrode assembly being inclined, and means for insulating the electrodes from each other;

a carrying-in conveyor provided at an upper end of said electrode assembly so as to carry in said electrode assembly a container accommodating particles to be mixed;

a carry-out conveyor provided at a lower end of said electrode assembly so as to receive said container passing through said electrode assembly and carry out the same; and a power supply for applying high voltage to the respective electrodes of said electrode assembly.

* * * * *